US007549837B2

(12) United States Patent
Hackworth et al.

(10) Patent No.: US 7,549,837 B2
(45) Date of Patent: Jun. 23, 2009

(54) IMPELLER FOR CENTRIFUGAL PUMP

(75) Inventors: Matthew Hackworth, Manvel, TX (US); David Eslinger, Collinsville, TX (US); Norwood R. Harrell, Dewey, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 202 days.

(21) Appl. No.: 11/638,211

(22) Filed: Dec. 13, 2006

(65) Prior Publication Data

US 2008/0101921 A1 May 1, 2008

Related U.S. Application Data

(60) Provisional application No. 60/863,059, filed on Oct. 26, 2006.

(51) Int. Cl.
*F01D 5/04* (2006.01)

(52) U.S. Cl. ..... 415/120; 416/186 R; 416/228

(58) Field of Classification Search ..... 415/120; 416/186 R, 228
See application file for complete search history.

(56) References Cited

U.S. PATENT DOCUMENTS 2,228,207 A 1/1941 Forssell
3,904,306 A * 9/1975 Navelsaker ..... 415/52.1
4,278,399 A * 7/1981 Erickson ..... 415/199.1
4,872,808 A 10/1989 Wilson
5,201,848 A 4/1993 Powers
5,628,616 A * 5/1997 Lee ..... 415/58.2
6,299,409 B1 * 10/2001 Matsunaga et al. ..... 415/206
6,558,120 B2 * 5/2003 Kim et al. ..... 416/186 R
6,726,449 B2 4/2004 James
6,854,517 B2 * 2/2005 Gay et al. ..... 166/369
7,179,050 B2 * 2/2007 Hopfensperger ..... 415/204
2005/0074331 A1 4/2005 Watson
2006/0245945 A1 11/2006 Wilson

* cited by examiner

*Primary Examiner*—Igor Kershteyn
(74) *Attorney, Agent, or Firm*—James L. Kurka; Kevin B. McGoff; Chyau Liang

(57) ABSTRACT

A centrifugal pump includes a rotatable shaft; and at lest one impeller attached to the rotatable shaft, wherein the at least one impeller includes a top plate, and a bottom plate, and a plurality of vanes enclosed between the top plate and the bottom plate, wherein at least one of the plurality of vanes has a trailing end that comprises a first surface that adjoins the top plate substantially at an outer edge of the top plate and a second surface that is substantially flush with an axially outward surface of the bottom plate.

12 Claims, 7 Drawing Sheets

IMPELLER FOR CENTRIFUGAL PUMP

CROSS-REFERENCE TO RELATED APPLICATIONS

The present application claims priority of U.S. Provisional Patent Application Ser. No. 60/863,059 filed on Oct. 26, 2006. This Provisional Application is incorporated by reference in its entirety.

BACKGROUND OF INVENTION

1. Field of the Invention

The invention relates generally to submersible pumps for use in oil field operations. In particular, embodiments relate to methods and apparatuses for moving fluid through one or more stages of an electrical submersible pump.

2. Background Art

Pumping systems driven by motors are used to extract or move fluid and gas. In subsurface operations such as in a wellbore environment, typically electric submersible pumping (ESP) systems are used in the production of hydrocarbon-based fluids. Unlike conventional motors in surface operations, a motor used in a submersible pumping system needs to be submersed in well fluids. The submersible motor is sealed from surrounding well fluids by a motor protector.

A submersible pumping system in the prior art (U.S. Patent Application Publication No. 20050074331) is illustrated in FIG. 1. The pumping system 100 is located within a wellbore 102 in a geological formation 104 containing fluids such as oil. The wellbore 102 is protected with a casing 106 having perforations 108 through which fluids flow from formation 104 into the wellbore 102. The pumping system 100 includes a centrifugal pump 110 having an intake 112, a submersible motor 114 and a motor protector 116. The system 100 is suspended within the wellbore 102 by a deployment system 118. A power cable 120 provides electric power to the submersible motor 122. When pumping, wellbore fluids are introduced into the intake unit 112, and are passed into an intake on the centrifugal pump 110, and out to a tubing string for discharge to the earth's surface.

In FIG. 1, the pump section 100 is located above the motor section 114. Other configurations of pumping systems also exist. For example, a charge pump section may be connected ahead the centrifugal pump 20 in a tandem configuration. ESP systems can also have a pump section located below a motor section.

In addition to using a pump to pump oil to the surface, a centrifugal pump can also be positioned in a wellbore in an inverted position to pump fluids downhole, e.g., during wellbore cleaning.

SUMMARY OF INVENTION

In one aspect, embodiments disclosed herein relate to centrifugal pumps. A centrifugal pump in accordance with one embodiment of the invention includes a rotatable shaft; and at lest one impeller attached to the rotatable shaft, wherein the at least one impeller includes a top plate, and a bottom plate, and a plurality of vanes enclosed between the top plate and the bottom plate, wherein at least one of the plurality of vanes has a trailing end that comprises a first surface that adjoins the top plate substantially at an outer edge of the top plate and a second surface that is substantially flush with an axially outward surface of the bottom plate.

In another aspect, embodiments disclosed herein relate to impellers for centrifugal pumps. An impeller in accordance with one embodiment of the invention includes a top plate, and a bottom plate, and a plurality of vanes enclosed between the top plate and the bottom plate, wherein at least one of the plurality of vanes has a trailing end that comprises a first surface that adjoins the top plate substantially at an outer edge of the top plate and a second surface that is substantially flush with an axially outward surface of the bottom plate.

In another aspect, embodiments disclosed herein relate to methods of pumping fluids. A method in accordance with one embodiment of the invention includes pumping the fluid with a centrifugal pump, wherein the centrifugal pump that includes a rotatable shaft; and at lest one impeller attached to the rotatable shaft, wherein the at least one impeller includes a top plate, and a bottom plate, and a plurality of vanes enclosed between the top plate and the bottom plate, wherein at least one of the plurality of vanes has a trailing end that comprises a first surface that adjoins the top plate substantially at an outer edge of the top plate and a second surface that is substantially flush with an axially outward surface of the bottom plate.

Other aspects and advantages of the invention will become apparent from the following description and the attached claims.

It is to be understood that the drawings are to be used for the purpose of illustration only, and not as a definition of the metes and bounds of the invention, the scope of which is to be determined only by the scope of the appended claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and "downwardly", "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Embodiments of the invention relates to components of a centrifugal pump. The centrifugal pump may be adapted to be positioned in a wellbore, either in a normal position for pumping fluids uphole or in an inverted position to pump fluids downhole. The centrifugal pump may be part of an electric submergible pumping (ESP) system. The centrifugal pump in general includes a pump housing, a rotatable shaft positioned within the pump housing, at least one pump stage positioned within the pump housing, with each pump stage comprising an impeller connected to and fixed relative to the shaft, and a stationary diffuser, and an upthrust bearing assembly positioned within the pump housing and comprising a rotatable thrust plate connected to the shaft and cooperating with a stationary thrust plate supported to the pump housing. Specific embodiments of the invention will now be described with reference to the FIGURES. Like elements in the various FIGURES will be referenced with like numbers for consistency.

Figure 1:
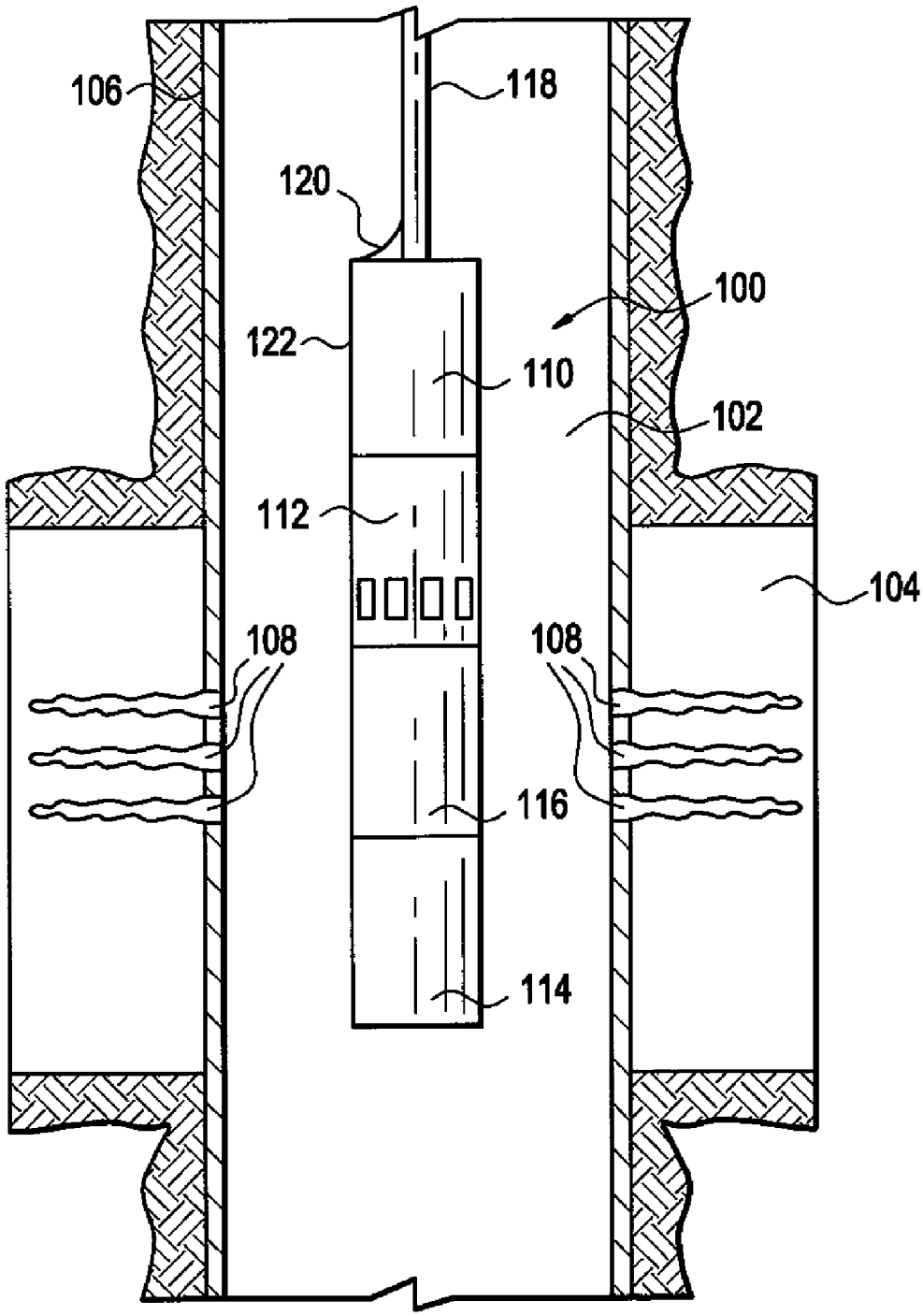
FIG. 1 PRIOR ART
FIG. 1 shows a pumping system in the prior art.
Figure 2:
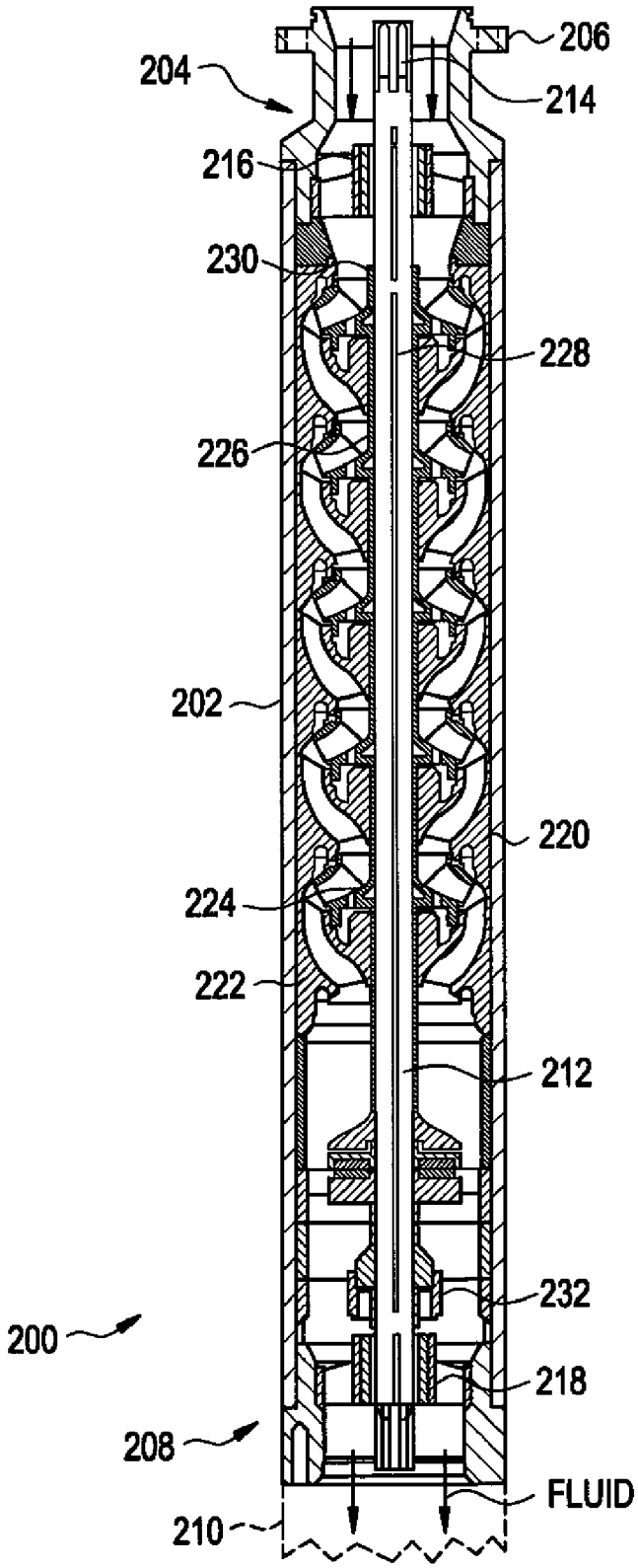
FIG. 2 shows a cross-sectional view of a centrifugal pump.

Referring to FIG. 2, in accordance with one embodiment of the invention, a centrifugal pump 200 has a pump casing or housing 202. A first end 204 of the housing 202 has a flange 206 adapted to be connected to a motor protector (shown as 116 in FIG. 1) or an electric motor (shown as 114 in FIG. 1). A second end 208 of the pump housing 202 includes interconnection devices 210, such as threads, for connecting to a fluid discharge conduit (not shown).

A rotatable shaft 212 extends, preferably coaxially, through the pump housing 202. The rotatable shaft 212 includes splines 214 on one end for power transfer interconnection with the shaft of the motor protector, electric motor, and/or tandem pump (not shown). The shaft 212 is centered and journaled for rotary motion by a first longitudinal bearing 216, disposed in the housing 202 adjacent to the first end 204, and a second longitudinal bearing 218, disposed in the housing 202 adjacent to the second end 208.

At least one pump stage 220 is disposed in the housing 202 between the first end 204 and the second end 208. The pump stage 220 has a stationary diffuser 222 and a co-operable rotating impeller 224. The impellers 224 are connected to the shaft 212, using pins or keys 226 that fit into a longitudinal slot 228 in the outer surface of the shaft 212, so that they rotate with the shaft 212. The impellers 224 are also fixed, using pins or keys, to the shaft 212 so that the impellers 224 will remain generally in the same longitudinal position on the shaft 212.

The pump configuration shown in FIG. 2 is known as a fixed-impeller design, which is distinct from a floating impeller design where the impellers are permitted to move longitudinally relative to the shaft. The impellers 224 are preferably fixed relative to the shaft 212 with collet rings 230 that are rigidly connected to the shaft 212 to abut a first (uppermost) impeller 224 and a lower compression nut 232.

Although the pump 200 is shown to pump fluid downhole shown in the direction indicated by the arrows, those of ordinary skill in the art will recognize that embodiments of the invention can also be used to pump fluid uphole.

Figure 3A:
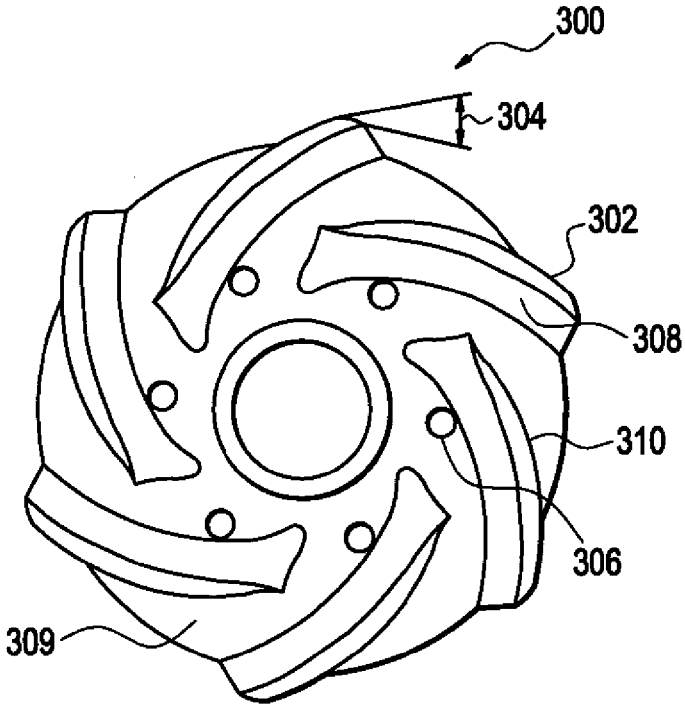
FIG. 3A PRIOR ART
FIG. 3A shows a top view of a semi-open impeller in the prior art.
Figure 3B:
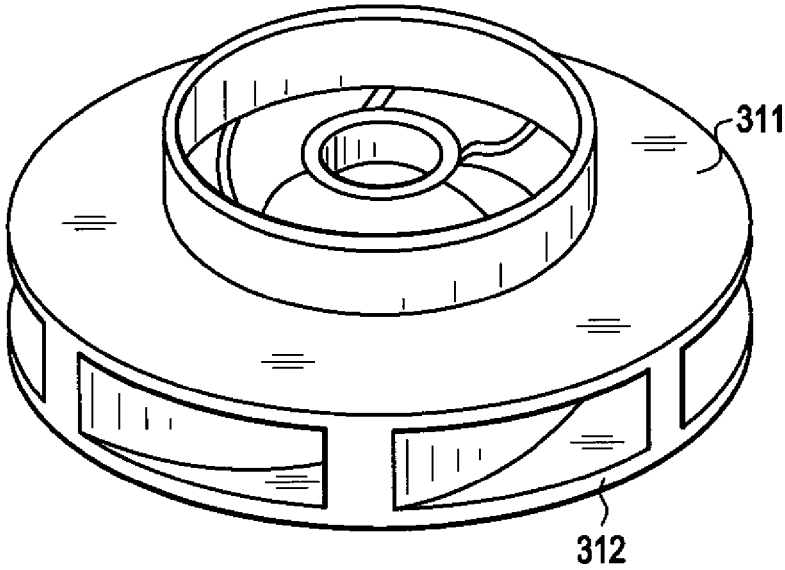
FIG. 3B PRIOR ART
FIG. 3B shows an enclosed impeller.

FIG. 3A illustrates a top view of an impeller 300 in the prior art. The impeller 300 includes a number of vanes 302 that discharge the fluid at an exit angle 304. The impeller 300 has balance holes 306 located between vanes 302, typically positioned closer to a back, or concave, side 308 than to the pressure, or convex, side 310 of each vane 302. The impeller 300 shown in FIG. 3A is a semi-open impeller, which has vanes attached to a bottom plate 309. FIG. 3B shows an alternative configuration of a enclosed impeller, in which vanes are enclosed by a top plate 311 and a bottom plate 312. In a third configuration (not shown), an impeller may have no plate and the vanes are attached to the center hub.

The rotating vanes accelerate fluid and discharge the fluid at a high velocity, creating a differential pressure to move the fluid down stream of the pump. Depending on the flow direction relative to the rotation axis, centrifugal pumps may be classified as radial-flow pump, axial-flow pumps, and mixed-flow pumps.

Figure 4:
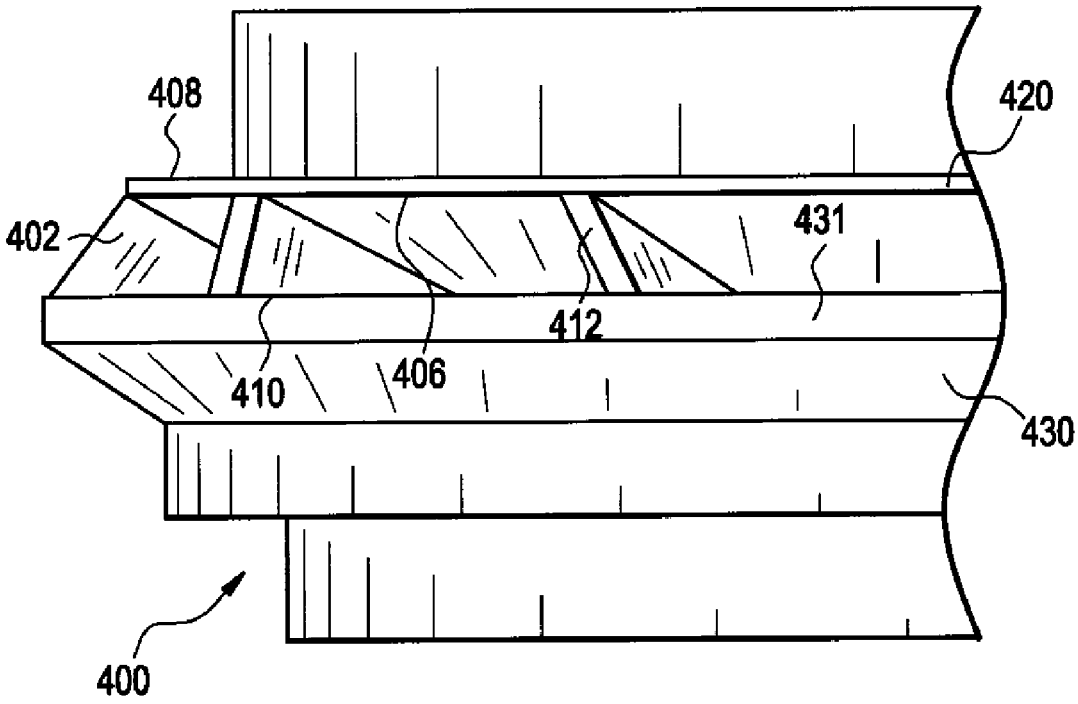
FIG. 4 PRIOR ART
FIG. 4 shows a side view of a section of a prior art impeller.

FIG. 4 shows a side view of a conventional impeller 400 commonly used in downhole centrifugal pumps. The impeller 400 is an enclosed impeller, having a top plate 420 and a bottom plate 430. "Top" and "bottom" are as they appear in the figures. A plurality of vanes 402 are mounted to a hub (not shown). The hub is fixed to a rotatable drive shaft (shown as 212 in FIG. 2). The top plate 420, as shown, has an inner edge 406 and an outer edge 408, and the bottom plate 430 an inner edge 410. The "edge" as used herein refers to where two planes meet, and "inner" refers to the side closer to the vanes. The vane 402 has a trailing end 412. The "trailing end" of a vane refers to the end away from the center hub, i.e., the axially outward end. "Axially outward" means away from the central hub (or shaft). The trailing end 412 may have a surface facing axially outward, as shown in FIG. 4. However, if the vane tapers at this end, the trailing end 412 will be an edge (where the two side surfaces meet) without the surface. The trailing end 412 adjoins the top plate 420 at the inner edge 406 and adjoins the bottom plate 430 at the inner edge 410.

Figure 5:
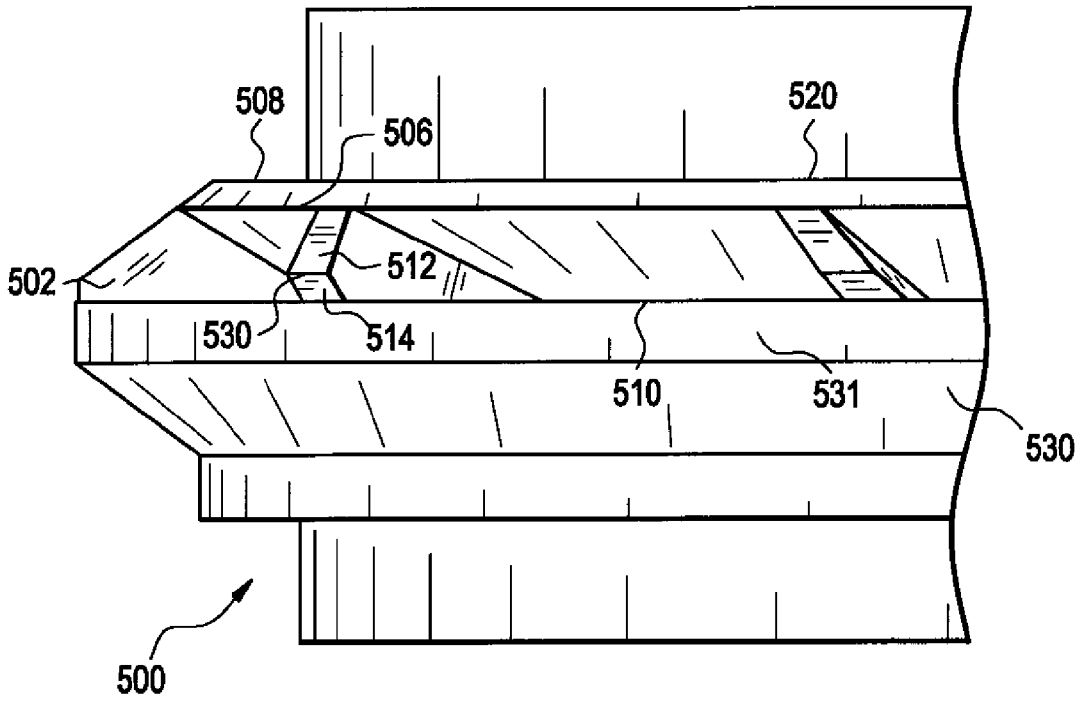
FIG. 5 illustrates a side view of a section of a prior art impeller with an extended vane configuration.

FIG. 5 shows an improved impeller 500 with an "extended" vane 502. The vane 502 trailing end has a first surface 512 and a second surface 514. The two surfaces adjoins at an edge 530. One difference between impeller 400 in FIG. 4 and impeller 500 in FIG. 5 lies in the additional surface 514 in impeller 500. The surface 514 is substantially flush with the axially outward surface 531 of the bottom plate 530. Note that "flush" with a surface as used herein refers to two surfaces that are substantially on the same plane.

Figure 6:
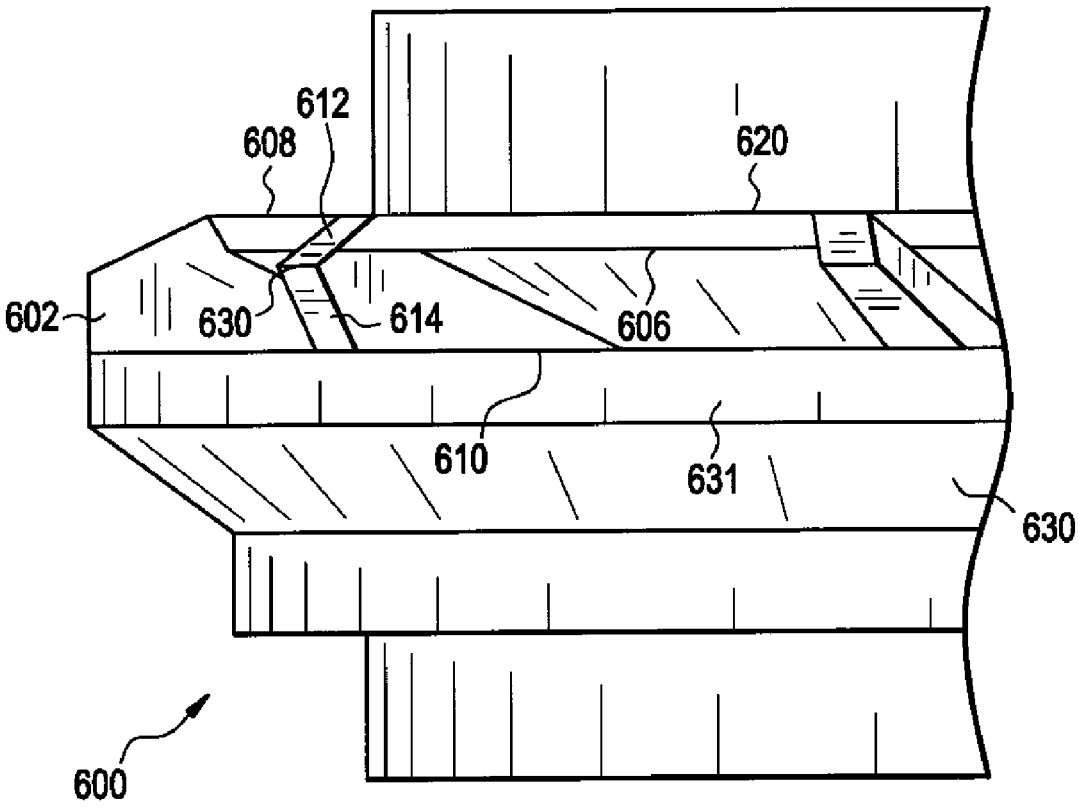
FIG. 6 illustrates a side view of section of an impeller with a hub vane configuration in accordance with one embodiment of the invention.

FIG. 6 shows an impeller 600 in accordance with an embodiment of the invention. The impeller 600 includes a plurality of vanes 602 enclosed between a top plate 620 and a bottom plate 630. The top late 620 has an inner edge 606 and an outer edge 608, and the bottom plate has an inner edge 610. The vane 602 trailing end has a first surface 612 and a second surface 614. In this embodiment, the first surface 612 passes over the inner edge 606 and meets the outer edge 608 of the top plate 620. That is, the first surface 612 adjoins the top plate 620 substantially at the outer edge 608. In addition, the second surface 614 is substantially "flush" with, i.e., on the same surface of, the axially outward surface 631 of the bottom plate 630. This configuration is referred to as the "hub vane" configuration.

In accordance with some other embodiments of the invention, the first surface 612 and second surface 614 do not form an edge 630 as shown in FIG. 6. Rather, the first surface 612 and second surface 614 adjoins smoothly and effectively become one curved surface. The single "curved" surface may adjoins the outer edge 608 of the top plate 620 and the axially outward surface 631 or the bottom plate 630.

Figure 7:
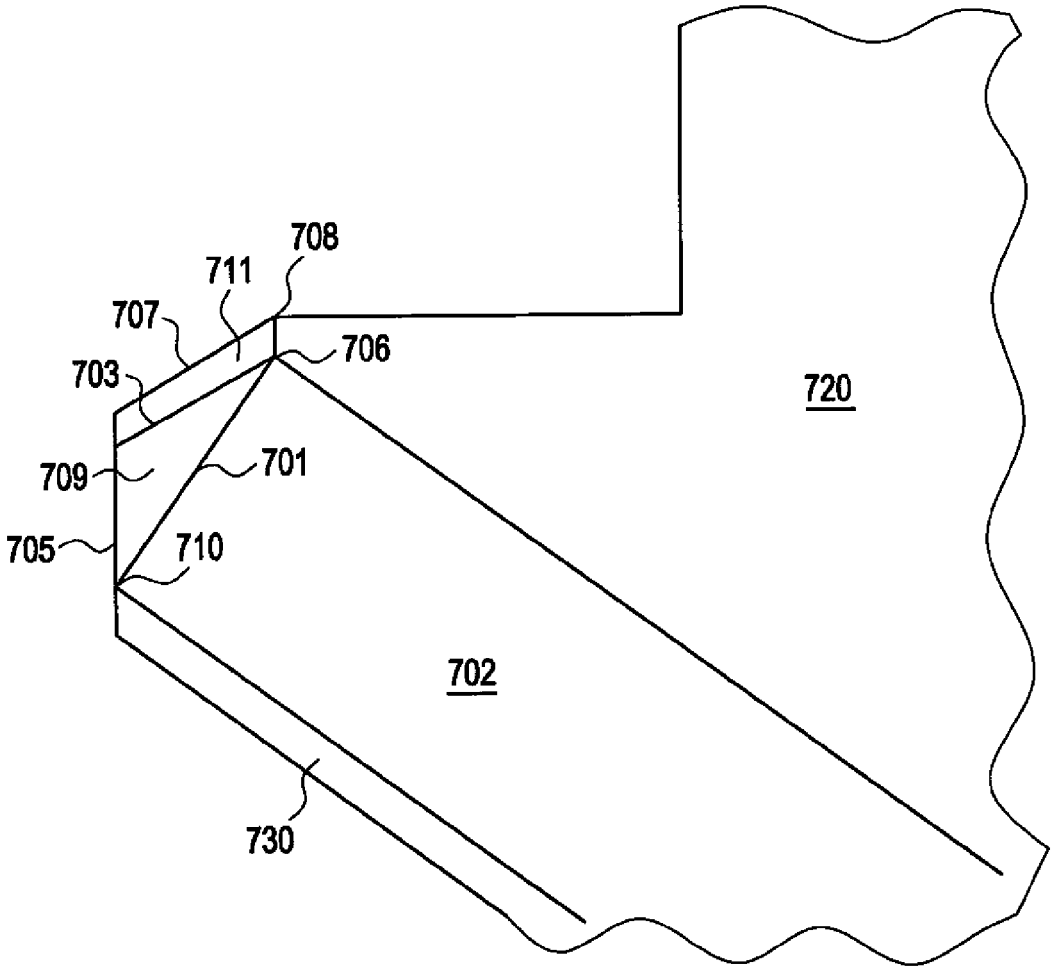
FIG. 7 shows a schematic diagram illustrating the differences among the conventional vane, the extended vane, and the hub vane.

FIG. 7 shows a schematic diagram illustrating how the bladed surface area changes with the three different configurations shown in FIGS. 4-6. The top plate 720 has an inner edge 706 and an outer edge 708, and the bottom plate 730 has an inner edge 710. In a conventional vane configuration, a trailing surface 701 of the vane 702 adjoins the inner edge 706 of the top plate 720 and the inner edge 710 of the bottom plate 730.

In an extended vane configuration, the vane 702 has a first surface 703 and a second surface 705. The first surface 703 adjoins the inner edge 706 of the top plate 720. The second surface 705 is substantially flush with the axially outward surface 731 of the bottom plate 730.

In the hub vane configuration, the first surface 707 passes over the inner edge 706 and adjoins the outer edge 708 of the top plate 720, and the second surface 705 is flush with the axially outward surface 731 of the bottom plate 730. Note that while this illustrated example has a first surface 707 and a second surface 705, these two surfaces may become two "edges" if the vane tapers to become a thin plate on this end. The description of two surfaces herein is intended to include two edges in this scenario.

The extended vane configuration has an increased, compared with the conventional vane configuration, bladed area 709. The hub vane configuration has a further increased bladed area 711. The increase blade area will be more efficient in moving fluids. Indeed, in experimental studies, an impeller with a hub vane configuration has a demonstrated ~6% improvement in lift, as compared with the extended vane configuration, without sacrificing pump efficiency.

The invention described above has various advantages. For example, the hub vane configuration has an increased bladed area near the trailing end of the vane, where the impeller is most efficient in generating lift. In addition, embodiments of the invention improves the ease of the machining and subsequent clean-up operations involved in the making of the impellers. Further, some embodiments of the invention may improve the impeller strength, as compared with conventional configurations.

While the invention has been described with respect to a limited number of embodiments, those skilled in the art, having benefit of this disclosure, will appreciate that other embodiments can be envisioned that do not depart from the scope of the invention as disclosed herein. Accordingly, the scope of the invention shall be limited only by the attached claims.

What is claimed is:

1. A centrifugal pump, comprising:

a rotatable shaft; and at lest one impeller attached to the rotatable shaft, wherein the at least one impeller includes a top plate having an inner edge and an outer edge, and a bottom plate, and a plurality of vanes enclosed between the top plate and the bottom plate, wherein at least one of the plurality of vanes has a trailing end that comprises a first surface passing over the inner edge of the top plate and adjoining the top plate substantially at the outer edge of the top plate and a second surface that is substantially flush with an axially outward surface of the bottom plate, wherein the first surface and the second surface are not perpendicular to each other.

2. The pump of claim 1, wherein the first surface and the second surface at the trailing end meet to form an edge.

3. The pump of claim 2, wherein the first surface and the second surface at the trailing end meet to form a curved surface.

4. The pump of claim 1, wherein the top plate or the bottom plate of the impeller comprises a plurality of balance holes.

5. The pump of claim 1, wherein the pump is part of an electric submersible pump.

6. An impeller for a centrifugal pump, comprising:

a top plate having an inner edge and an outer edge, and a bottom plate, and a plurality of vanes enclosed between the top plate and the bottom plate, wherein at least one of the plurality of vanes has a trailing end that comprises a first surface passing over the inner edge of the top plate and adjoining the top plate substantially at the outer edge of the top plate and a second surface that is substantially flush with an axially outward surface of the bottom plate. wherein the first surface and the second surface are not perpendicular to each other.

7. The impeller of claim 6, wherein the first surface and the second surface at the trailing end meet to form an edge.

8. The impeller of claim 6, wherein the first surface and the second surface at the trailing end meet to form a curved surface.

9. The impeller of claim 6, wherein the top plate or the bottom plate comprises a plurality of balance holes.

10. A method of pumping a fluid, comprising:

pumping the fluid with a centrifugal pump, wherein the centrifugal pump comprises:

a rotatable shaft; and at lest one impeller attached to the rotatable shaft, wherein the at least one impeller includes a top plate having an inner edge and an outer edge, and a bottom plate, and a plurality of vanes enclosed between the top plate and the bottom plate, wherein at least one of the plurality of vanes has a trailing end that comprises a first surface passing over the inner edge of the top plate and adjoining the top plate substantially at the outer edge of the top plate and a second surface that is substantially flush with an axially outward surface of the bottom plate. wherein the first surface and the second surface are not perpendicular to each other.

11. The method of claim 10, wherein the pumping the fluid is performed in a well penetrating a subterranean formation.

12. The method of claim 11, wherein the centrifugal pump is part of an electric submersible pump disposed in the well.

* * * * *

UNITED STATES PATENT AND TRADEMARK OFFICE

CERTIFICATE OF CORRECTION

PATENT NO. : 7,549,837 B2
APPLICATION NO. : 11/638211
DATED : June 23, 2009
INVENTOR(S) : Hackworth et al.

It is certified that error appears in the above-identified patent and that said Letters Patent is hereby corrected as shown below:

At page 1, the Abstract, line 1, replace “lest” with “least”.

At column 1, line 58, replace “lest” with “least”.

At column 2, line 12, replace “lest” with “least”.

At column 5, line 39, replace “lest” with “least”.

At column 6, line 19, delete “.” after “plate” and before “wherein”.

At column 6, line 32, replace “lest” with “least”.

Signed and Sealed this
Fifth Day of February, 2013

Teresa Stanek Rea
*Acting Director of the United States Patent and Trademark Office*